United States Patent [19]

Jenkins

[11] 4,232,473

[45] Nov. 11, 1980

[54] RECONFIGURABLE LOOP OF TUBULAR ELEMENTS

[76] Inventor: Sherman Jenkins, 1401 Columbus Ave., Livermore, Calif. 94550

[21] Appl. No.: 895,007

[22] Filed: Apr. 10, 1978

[51] Int. Cl.[3] ..... A63H 33/00; A63H 33/08; A63H 33/06

[52] U.S. Cl. ..... 46/1 R; 46/25; 46/28; 285/DIG. 22

[58] Field of Search ..... 46/1 R, 27–30; 273/153, 155, 157, 158; 285/DIG. 22

[56] References Cited

U.S. PATENT DOCUMENTS

| | | | |
|---|---|---|---|
| 1,347,008 | 7/1920 | Franklin | 46/29 |
| 1,446,868 | 2/1923 | Baker | 46/29 |
| 2,985,469 | 5/1961 | Bowman | 285/DIG. 22 |
| 3,074,203 | 1/1963 | Paksy | 46/29 |
| 3,222,072 | 12/1965 | Dreyer | 273/153 R |
| 3,363,361 | 1/1968 | Helfer | 46/29 |
| 3,853,338 | 12/1974 | Wilson | 285/DIG. 22 |
| 3,900,984 | 8/1975 | Garelick | 46/1 R |
| 4,152,017 | 5/1979 | Abramson | 285/DIG. 22 |

FOREIGN PATENT DOCUMENTS

| | | | |
|---|---|---|---|
| 2720641 | 11/1977 | Fed. Rep. of Germany | 46/28 |

*Primary Examiner*—Louis G. Mancene
*Assistant Examiner*—Michael J. Foycik, Jr.
*Attorney, Agent, or Firm*—Spensley, Horn, Jubas & Lubitz

[57] ABSTRACT

A novelty toy device for forming a variety of geometric configurations. The device is constructed of a series of uniquely shaped members which form at least one closed loop. The members are joined together such that each member is axially rotatable with respect to adjacent members, thereby enabling the members to be twisted into a variety of shapes.

4 Claims, 12 Drawing Figures

10
12
14
16
22
23
24
25
30
32
34
36
38
40
42
44
46
48

10
12
23b
22b 10
12

10
12
23a
22a 12
52
54
50
52
52
50
52
12
12

12
60
56
58
62
64
64
62

RECONFIGURABLE LOOP OF TUBULAR ELEMENTS

BACKGROUND OF THE INVENTION

1. Field of the Invention

The present invention relates to toy devices, and more specifically, to a toy device which can be twisted into a plurality of configurations.

2. Prior Art

It has long been recognized that certain devices which enable the user to manually move the device have gained wide acceptance. Perhaps one of the earliest forms of such devices are "worry beads" which have been popular for hundreds of years in many middle eastern countries. While it is not certain what the reasons are for such beads to have remained popular, it is believed that it is related to the fact that the movement of the beads require some degree of manual dexterity. Other devices of this type include a "touch stone". A touch stone is generally a uniquely shaped stone which is slid across the fingers of the hand and provides the user with a pleasant feeling.

While devices of these types have only achieved limited success in the United States, it is believed that a device that could be twisted into a plurality of configurations would satisfy the user's needs for manual dexterity. On the other hand, there are a number of devices which can be twisted and flexed, but for a variety of reasons, have not gained wide acceptance. One of these devices is disclosed in U.S. Pat. No. 3,662,486. In that patent, a series of units are disclosed each having the shape of a polyhedron. Each polyhedron is equipped with connecting means such that individual polyhedrons may be connected to each other in order to form an elongated string or series. In one embodiment, they are joined together so as to form a closed loop which is capable of being turned up to 360° inside of itself. While the device set forth in the U.S. Pat. No. 3,662,486 does not allow one to manually rotate the device, each of the pieces is of rather complex geometry adding to the cost of such device. Furthermore, the number of geometric configurations which can be formed are substantially limited by the manner in which the polyhedrons are joined together. Other similar type devices are disclosed in U.S. Pat. Nos. 1,853,436; 2,208,149; and 3,977,683. In these patents, rod-like members are joined together at the ends thereof in order to form a variety of geometric configurations. However, the device shown in such patents are likewise specifically limited in terms of the geometric patterns which can be obtained, and do not provide the twisting action achieved by the device of the present invention. The present invention, therefore, represents an advancement in the art of moveable toy-like devices, and contains none of the aforementioned shortcomings associated with prior art devices. In addition, the method of joining each of the various members together of the present invention enables a wide variety of geometric configurations to be achieved while maintaining a generally closed loop configuration. The present invention thus provides a device which satisfies the need for manual dexterity, but does so in a manner which permits the device to be constructed of low cost components in a simple and straight forward manner.

BRIEF SUMMARY OF THE INVENTION

The present invention relates to twistable devices, and more specifically, to a device which while functioning primarily as a toy, can also be used to illustrate a wide variety of geometric patterns, as well as an aid where manual dexterity can be improved by the twisting action of the hands. In the present invention, a series of joining members are joined together such that each member is axially rotatable with respect to adjacent members. As each of the members are twisted, a plurality of geometric configurations can be made. Further, by providing the device with uniquely designed joining means, the device of the present invention can be made with low cost materials.

In one embodiment, the device of the present invention is comprised of a series of shaped tubes which are joined together so as to form a closed loop. The tubes are joined together by a cord which passes through each of the tubes. As the tubes are twisted, they are caused to axially rotate in such a manner that while a closed loop configuration is maintained, a plurality of configurations are achieved.

In other embodiments, the shapes of the joining members are changed and/or the means of joining the adjacent members together. In all such embodiments, however, the joining members are axially rotatable with respect to adjacent members, and enable the device to provide the user with a pleasing form of manual movement.

It is therefore one object of the present invention to provide a toy-like device which can be twisted into a plurality of configurations.

It is yet another object of the present invention to provide a device which enables various members to be joined together in a rotatable manner so as to maintain a general closed loop configuration.

It is yet another object of the present invention to produce a rotatable toy-like device in a simple and straight forward manner.

The novel features which are believed to be characteristic of the invention, both as to its organization and method of operation, together with further objective and advantages thereof will be better understood from the following description considered in connection with the accompanying drawings in which a presently preferred embodiment of the invention is illustrated by way of example. It is to be expressly understood, however, the the drawings are for the purpose of illustration and description only and are not intended as a definition of the limits of the invention.

DETAILED DESCRIPTION OF THE INVENTION

Figures 1, 2, 3, 4:
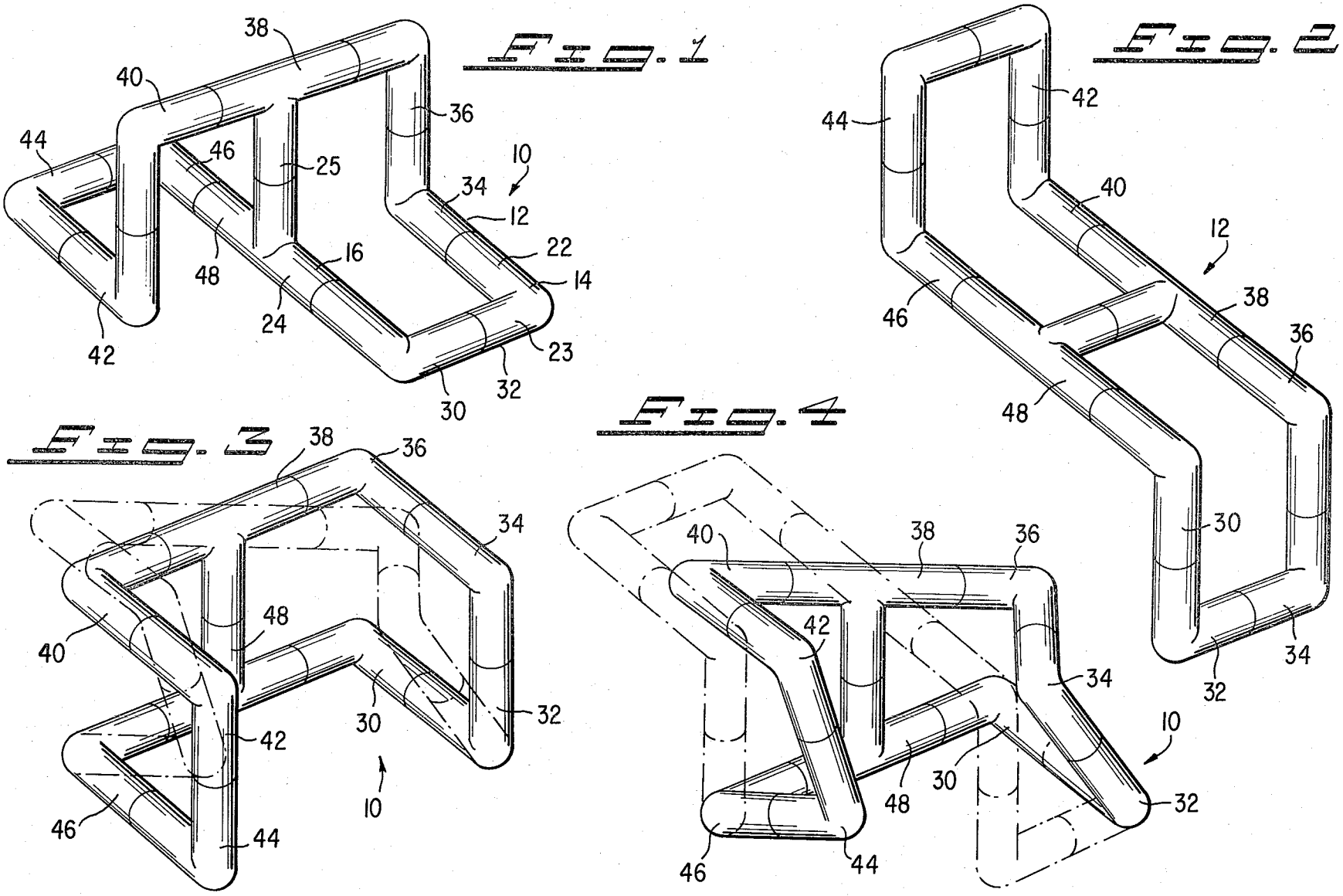
FIG. 1 is a perspective view showing a first embodiment of the novel device of the present invention.
FIG. 2 is a perspective view showing a different configuration of the first embodiment of the present invention.
FIG. 3 is a perspective view showing the twisting characteristics of the first embodiment of the present invention.
FIG. 4 is yet another perspective view showing the twisting characteristics of the first embodiment of the present invention.

Referring first to FIG. 1, the first embodiment of the present invention is clearly shown. In this embodiment, the device 10 is comprised of a series of joining members 12 which are rotatably joined together so as to form first and second closed loops. In the first embodiment of the present invention, two types of sections are used to form each joining member 12. These sections are indicated as sections 14 and 16. Section 14 forms a general right angle or L-shape bend and is comprised of a first sub-section 22 and a second sub-section 23. Section 16, in turn, has a generally T-shape configuration and is formed of intersecting sub-sections 24 and 25. In the first embodiment of the present invention, the device 10 is comprised of a series of ten interconnected members. These members are each identified as elements 30, 32, 34, 36, 38, 40, 42, 44, 46 and 48, respectively. More specifically, the first embodiment is comprised of eight right angle bend sections 14 and two T-shape sections 16. The result of interconnecting the various members 12 together is a configuration having two joined loops which can be twisted as hereinafter described.

As discussed hereinabove, one improvement of the present invention over the prior art is the fact that the joining members 12 of the present invention are joined to adjacent members so as to be axially rotatable. It has been found that this axial rotation provides the user with a pleasing form of manual movement. In addition, in the preferred embodiment, the members 12 are made of a plastic tubing such as is commonly used in the construction industry. Preferably, members 12 are made of polyvinyl chloride or other similar plastic tubing material. This type of tubing material not only enables the axial rotation to take place, but also has a smooth finish which provides the user with a pleasant feel.

Referring now to FIG. 2, one can see that the various members 12 have been axially rotated so as to form what is referred to herein as a "chair" configuration. One can see that members 42 and 44, as well as members 32 and 34, have been sufficiently twisted so as to form sections which are parallel with respect to each other at opposite ends of the device 10.

Referring now to FIGS. 3 and 4, one can see the twisting action illustrated by phantom lines of the various members 12 so as to achieve a plurality of geometric configurations. In the preferred embodiment, this is achieved by making each of the various members 12 axially rotatable with respect to adjacent members. This rotation, however, is such that as between two adjacent members, each member is axially rotatable a little more than 180° with respect to the adjacent member. After traveling a little more than 180° in one direction, the continued rotation of a member 12 will cause it to return to its initial starting point by traveling along the same path in the opposite direction. By such action, the entire device 10 can be twisted in a 360° manner.

Figures 5, 6, 7, 8, 9:
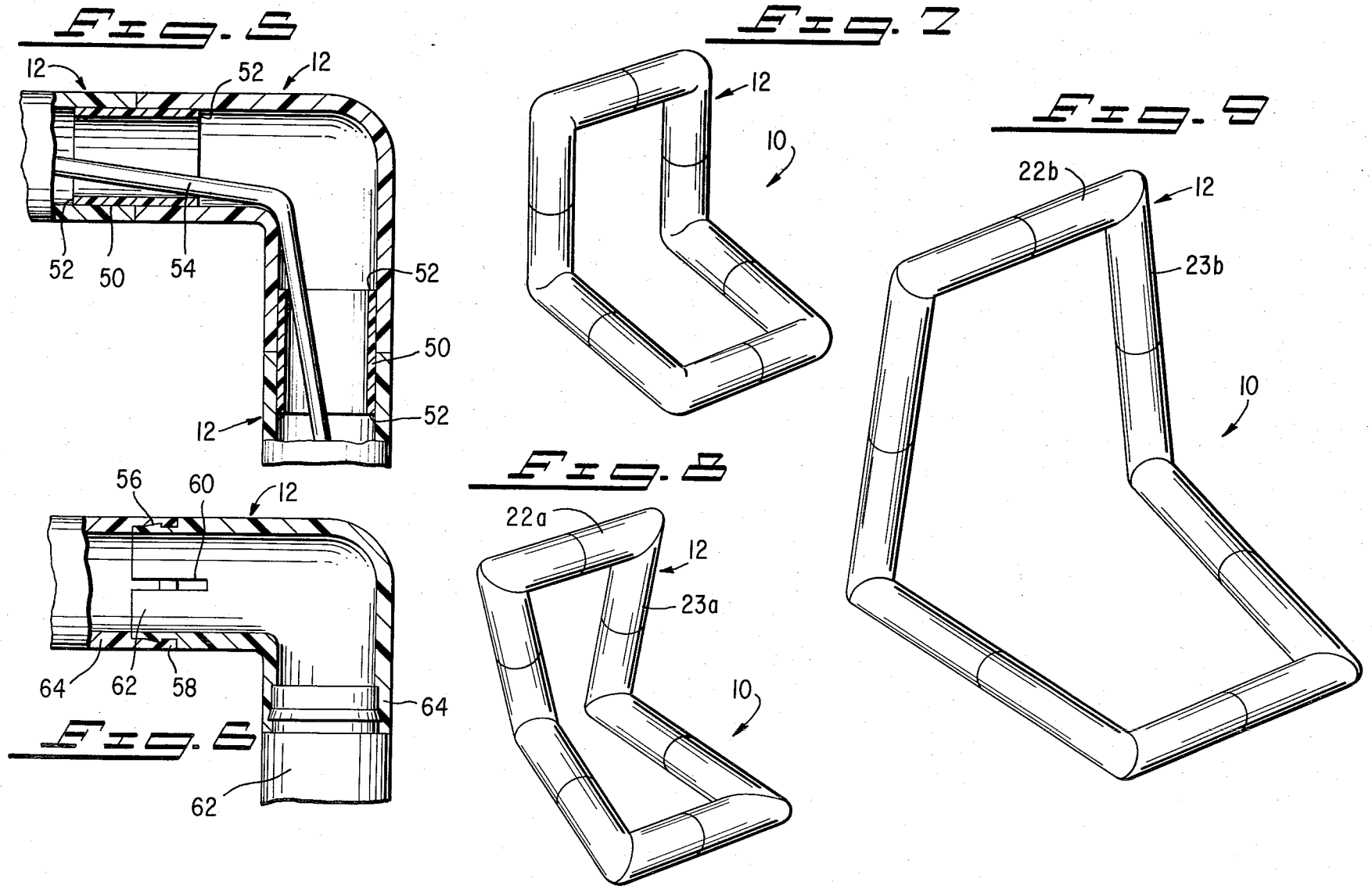
FIG. 5 is a cross-sectional view showing how the members are joined together.
FIG. 6 is a cross-sectional view showing another embodiment of how the members can be joined together.
FIG. 7 is a perspective view of a second embodiment of the present invention.
FIG. 8 is a perspective view of a third embodiment of the present invention.
FIG. 9 is a perspective view of a fourth embodiment of the present invention.

One problem with the prior art devices was that the means which were used to join the various sections together were such that axial rotation was precluded. The present invention enables the axial rotation to take place by disposing an elastic cord 54 or other similar member as shown in FIG. 5 which runs internally through the closed loop configuration through each of the members 12 and which also forms a closed loop. Cord 54 helps maintain the integrity of device 10 and whatever configuration into which the device 10 is twisted. In the preferred embodiment, a sleeve 50 is disposed between and circumferentially surrounded by adjacent members 12, and is positioned between ledge members 52 formed within each member 12. The sleeve member 50 helps maintain the integrity of the device 10 as it is being twisted, and further encourages the twisting action to take place.

Referring now to FIG. 6, a second embodiment of the means for joining the various members 12 together is illustrated. In this embodiment, a first end 62 of a member 12 is equipped with an outwardly extending rim member 56. An inwardly extending ledge member 58 is disposed on the second end 64 of each member 12. The rim member 56 is caused to flex inwardly as end 62 is pushed into end 64. Rim member 56 rides up on the ledge 58 and snaps outwardly so as to engage ledge 58. In this manner, an interlocking configuration is achieved between adjacent members 12 which enables the necessary axial rotation to take place. To encourage the necessary sliding and locking action, each member 12, adjacent end 62 thereof, may include a slot 60 which enables end 62 of the member 12 to be flexed inwardly. In this manner the necessary interlocking action between rim 56 and ledge 58 is further encouraged to take place. Of course, it is understood, that yet other configurations for joining the members 12 together are within the scope of this invention.

The twisting characteristics of the first embodiment of the device 10 will now be described. Assuming that members 12 are joined together as illustrated in either FIG. 5 or 6, and that the device 10 has the configuration shown in FIG. 1. Ten members, 38 through 48, inclusive, are thus joined together to form a two loop configuration. Assume further that members 42 and 44 are grasped by one hand, and that members 32 and 34 are grasped by the other hand. An opposed, rotational twisting force is then applied to members 32 and 34 and to members 42 and 44 respectively. The result is the configuration shown in FIG. 2, i.e. the chair configuration. Assume further that the same twisting force is again applied in the same opposed direction to members 32, 34 and members 42, 44. Eventually, the configuration illustrated in FIG. 3 will be achieved. Note in this configuration, that the device 10 has been twisted into what is referred to herein as a generally U-shape. Continued application of the twisting force as described above will cause the device 10 to go through the configuration illustrated in FIG. 4 and will ultimately return to the initial configuration illustrated in FIG. 1. The ability to continually rotate the members 12 so as to achieve the various configurations, is achieved by each adjacent member being axially rotatable through an angle of somewhat more than 180° before rotating back in the opposite direction. The ability to rotate the members 12 such that continued rotation causes the device 10 to go through various configurations and then repeat these configurations as the twisting action is continued is also achieved by coupling the various members 12 together such that axial rotation of one member 12 causes some axial movement between all the members 12.

Referring now to FIG. 7, the second embodiment of the device 10 of the present invention is illustrated. In the second embodiment, the members 12 are comprised of a series of general right angle or L-shape bends which are joined together in either of the manners hereinabove discussed. In this configuration, while only a single closed loop is formed, a plurality of geometric configurations can still be achieved by rotatably twisting the various members 12 into a predetermined configuration. Again, each of the adjacent members 12 is axially rotatable so as to achieve this twisting ability.

Referring now to FIG. 8, yet a third embodiment of the present invention is shown. In the third embodiment, the various members 12 are selected such that as between sub-sections 22*a* and 23*a*, an acute angle is formed. Even in this configuration, however, the members 12 are axially rotatable through an angle of somewhat more than 180° such that the device 10 can be twisted in a 360° manner so as to achieve a plurality of geometric configurations.

Referring now to FIG. 9, the fourth embodiment of the present invention is shown. In this embodiment, sub-sections 22*b* and 23*b* are joined together so as to form an obtuse angle thereinbetween. Again, the rotation of each member 12 is the same as hereinabove discussed, thus permitting the device 10 to achieve a plurality of configurations.

Figure 10:
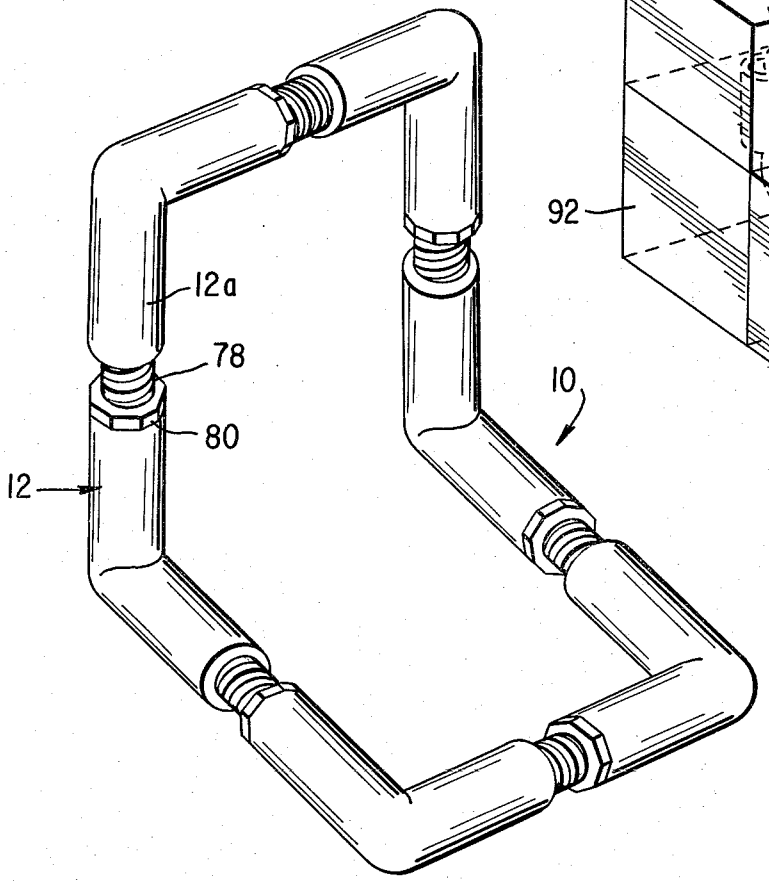
FIG. 10 is a perspective view of a fifth embodiment of the present invention and illustrates yet another manner in which the various members can be joined together.

Referring now to FIG. 10, a fifth embodiment of the present invention is illustrated. In the fifth embodiment, the means for joining the members 12 together comprise a threaded member 78 which has a flange section 80 integrally attached thereto. The flange section 80 is attached to one member 12 by glue or other means. The threaded member 78 is then screwed into an adjacent member 12*a*. The result of such configuration is what appears to be a "plumber's nightmare". The twisting action is still maintained, however, inasmuch as adjacent members are rotatable by approximately 180° and then return along the same path. As two adjacent members 12 and 12*a* shown in FIG. 10 are rotated in one direction, the threaded member 78 would be caused to be screwed into and then out of member 12*a* such that continued attachment between adjacent members is maintained. Thus, in the fifth embodiment of the present invention, the twisting and rotational aspects of the device 10 are maintained.

Figure 11:
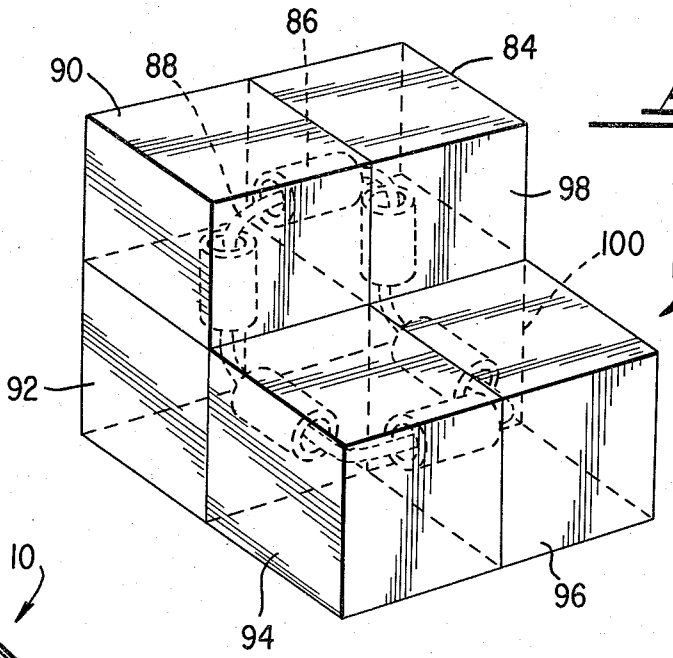
FIG. 11 is a perspective view showing a sixth embodiment of the present invention.
Figure 12:
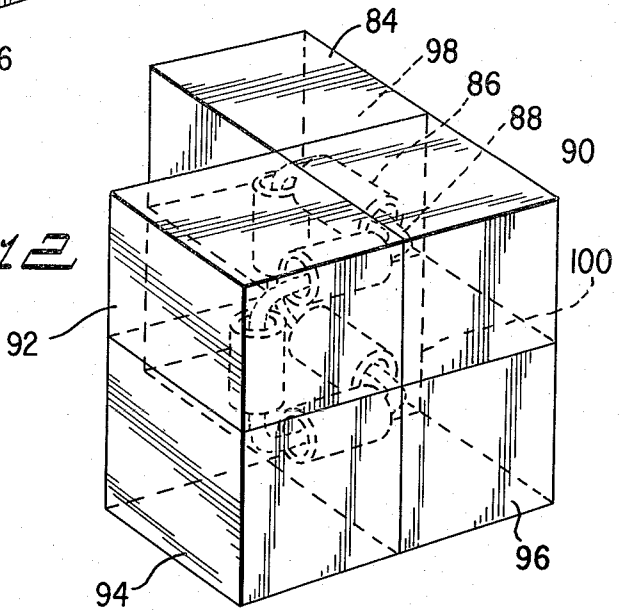
FIG. 12 is a perspective view of the sixth embodiment of the present invention which has been twisted into a different configuration.

Referring now to FIGS. 11 and 12, the sixth embodiment of the present invention is illustrated. In the sixth embodiment, a series of six blocks or cubes 84 each having six sides are joined together so as to form a specific configuration. Disposed within adjacent blocks is a sleeve 86 through which an elastic member 88 passes. As discussed hereinabove, a wide range of other means for joining the various blocks 84 together are within the scope of the present invention. In the sixth embodiment, six blocks, blocks 92, 94, 96, 98 and 100 are joined together as hereinabove described. Referring now to FIG. 12, one can see that the blocks 84 have been rotated such that block 92 is now disposed atop block 94 while block 90 is disposed atop block 96. This is achieved by axially rotating the various block members with respect to each other made possible by sleeve member 86. The elastic member 88 helps maintain the device 10 in any specific configuration.

As discussed hereinabove, in embodiments 1 through 5, the members 12 are formed of rod-like members formed of rigid plastic tubing. In the sixth embodiment of the present invention, members 84 have a polygonal configuration and may be made from plastic material such as polyvinylchloride, acrylates, etc. However, the underlying feature with respect to all such embodiment is that between all adjacent members, each member is axially rotatable with respect thereto. This enables the device 10 of the present invention to be axially rotated into a plurality of uniquely shaped configurations.

Although this invention has been disclosed and described with reference to particular embodiments, the principles involved are susceptible to yet other applications which will be apparent to persons skilled in the art. For example, various handle members can be attached to one or more of the members 12 so as to enable two or more persons to twist the device 10. This invention, therefore, is not intended to be limited to the particular embodiments herein disclosed.

What is claimed is:

1. A twistable novelty device consisting of:

six rigid tubular elbows each having a generally L-shaped configuration rotatably connected end to end forming a single closed loop structure, each abutting pair of elbows being mutually rotatable about the axis common to the abutting ends of said pair without axial displacement therebetween, said elbows being joined together to form a structure in which each leg of the elbows lie in one of two generally perpendicular intersecting planes.

2. A twistable novelty device comprising:

eight L-shaped and two T-shaped rigid tubular elbows rotatably connected end to end forming two interconnected loops, all of the ends of said elbows being interconnected, each abutting pair of elbows being mutually rotatable about the axis common to the abutting ends of said pair without axial displacement therebetween.

3. A twistable novelty device comprising:

a plurality of rigid tubular elbow members, each having a generally L-shaped configuration rotatably connected end to end forming a single closed loop structure, each abutting pair of elbows being mutually rotatable about the axis common to the abutting ends of said pair, and wherein each elbow is internally threaded with a screw-like thread at one end and correspondingly externally threaded at the other end, the externally threaded end of each elbow being partially threadingly inserted within the internally threaded end of the abutting elbow, such that as the elbows are rotated, lateral alternatingly axially inward and outward threaded movement occurs between each adjoining pairs of elbows, without separation of the pairs of elbows.

4. A novelty device according to claim 2, wherein, each said elbow has an outwardly extending rim member adjacent one end thereof and a ledge member adjacent the other end thereof and wherein the rim member of one elbow is rotatably disposed in the ledge member of an adjacent elbow such that each abutting pair of elbows is mutually rotatable about the axis common to the abutting ends of said pair without axial displacement therebetween.

* * * * *